United States Patent [19]

Merkel

[11] Patent Number: 4,668,948

[45] Date of Patent: May 26, 1987

[54] DISPENSER MALFUNCTION DETECTOR

[75] Inventor: Stephen L. Merkel, Bay Village, Ohio

[73] Assignee: Nordson Corporation, Amherst, Ohio

[21] Appl. No.: 815,114

[22] Filed: Dec. 26, 1985

Related U.S. Application Data

[63] Continuation of Ser. No. 474,201, Mar. 10, 1983, abandoned.

[51] Int. Cl.[4] ..... G08B 21/00; B05B 12/00

[52] U.S. Cl. ..... 340/825.3; 340/606; 239/71; 73/37; 221/1

[58] Field of Search ..... 340/825.3, 611, 606; 73/861.03, 37; 364/510; 239/71; 137/557; 222/373, 1

[56] References Cited

U.S. PATENT DOCUMENTS

| | | | |
|---|---|---|---|
| 3,482,781 | 12/1969 | Sharpe | 239/71 |
| 3,816,025 | 6/1974 | O'Neill | 417/9 |
| 3,855,480 | 12/1974 | Striker et al. | 307/118 |
| 3,976,989 | 8/1976 | Smith | 137/552.7 |
| 4,019,653 | 4/1977 | Scherer et al. | 222/1 |
| 4,023,020 | 5/1977 | Lestradet | 364/510 |
| 4,063,824 | 12/1977 | Baker et al. | 417/43 |
| 4,072,934 | 2/1978 | Hiller et al. . | |
| 4,149,254 | 4/1979 | Molusis | 73/861.03 |
| 4,188,624 | 2/1980 | Hochsprung et al. | 340/611 |
| 4,315,317 | 2/1982 | Orchard et al. | 239/71 |
| 4,430,886 | 2/1984 | Rood | 73/37 |

*Primary Examiner*—Donald J. Yusko

*Attorney, Agent, or Firm*—Wood, Herron & Evans

[57] ABSTRACT

A dispenser for fluid under pressure has a sensor affixed to it to sense the pressure of the fluid proximate the dispenser discharge opening to generate a pressure reflective signal. A comparator is connected to receive the pressure reflective signal to compare the pressure signal with a preselected band of pressure values which are selected to reflect operating pressures when the dispenser discharge opening is opened. The comparator generates a malfunction signal when the sensed pressure signal is outside the preselected band.

5 Claims, 11 Drawing Figures

PRE-SHAPER

DISPENSER MALFUNCTION DETECTOR

This application is a continuation of application Ser. No. 474,201 filed Mar. 10, 1983, abandoned.

BACKGROUND OF THE INVENTION

1. FIELD OF THE INVENTION:

This invention relates to monitoring devices and more particularly relates to monitoring devices used to detect malfunctioning fluid dispensers.

1. STATEMENT OF ART:

Typical fluid dispensing systems in one form include a pump having an inlet connected to a supply of material and a discharge connected to a dispenser. For precision dispensing, the dispenser may include a valve which permits fluid to pass through a discharge opening such as a nozzle or fluid tip. In some systems the dispenser valve is operated by a programmed control device so that fluid is dispensed in precise or metered amounts.

In many applications it is often desirable that precise patterns, metered amounts or both be dispensed. In operation, precision or accurate metering is affected by many factors including nozzle wear, fluid impurities, nozzle clogging, and pump performance.

Clogging of the material flow path, especially in the dispenser, is a typical problem that adversely affects the performance of precision dispensing systems. For example, in precision dispensing systems used to coat the interior surface of multipiece can bodies, a clogged or worn nozzle may cause the can body to be incompletely or improperly coated.

The can bodies are typically coated during the process of manufacture at rates of up to many hundreds of cans per minute. Thus, an improperly functioning dispenser and more particularly a clogged or worn nozzle can result in many improperly coated cans before detection by inspection or other known means. An improperly coated can may have an adverse effect on the can's ability to function for storage. In some cases, the can may suffer accelerated deterioration (i.e., shortened shelf life), and in others (e.g. for foods and beverages) the contents may be adversely affected (e.g., taste, spoilage). Improper coating, therefore, is undesirable and may also be costly because cans that are improperly coated typically are not usable.

Other systems, for example, those involving the precise deposition of thermoplastics or similar materials, are also susceptible to clogging. An example of such a system is described in U.S. Pat. No. 4,166,246—Matt. These systems are typically used in the manufacturing of packaging (e.g., cardboard cartons) and in product assembly. Clogging of the dispensing system may result in defective products and in turn result in delays or otherwise introduce undesirable additional costs in the manufacturing process.

Clog sensing systems heretofore known are not applicable or useful for the accurate and prompt clog sensing desired. For example, U.S. Pat. No. 4,072,934—Hiller, et al., discloses a method and apparatus for detecting blockages in a vapor flow line such as those used in liquid gasoline dispensing systems. Such an apparatus would not be useful in a precision coatings application because the nozzle condition, whether clogged or worn, cannot be determined. Hiller et al. determines whether a blockage exists in a vapor line by sensing the pressure on either side of the clog and activating an alarm when the differential pressure exceeds a predetermined maximum value.

U.S. Pat. No. 3,816,025—O'Neill describes a fluid circulation system for a paint spray installation. A secondary recirculation loop pressure sensor senses the pressure in the secondary loop dropping below a preselected value in order to shut down the paint supply pump if a paint flow line should break.

U.S. Pat. No. 4,315,317—Orchard et al. discloses a measuring, computing and recording system for monitoring of spray application parameters for pesticides dispensed from an aircraft. Orchard et al. records pressure information, total liquid volume, liquid flow rate, spray passes and spray time. The user is required to interpret the results of the items recorded to determine whether among other things a clog condition is present. Such a delay in system condition determination is wholly unacceptable for precision coating applications such as the can body example illustrated above.

U.S. Pat. No. 3,482,781—Sharpe contains a paint spray gun which uses air to atomize the paint during dispensing. A pressure gauge is affixed to the gun to indicate the pressure of the atomizing air during dispensing operation. This device cannot accurately and reliably determine whether the paint flow path is clogged.

There is no system presently known which quickly and automatically determines whether a dispenser is applying a coating material in other than a preselected or desired fashion.

SUMMARY OF THE INVENTION

In a system with a dispenser for fluid under pressure and a controller which provides operation signals to the dispenser to control the open and closed conditions thereof, a monitor evaluates dispenser operation. The monitor has a sensor affixed to the dispenser to sense the pressure of the fluid in the dispenser and to generate a signal reflective of the fluid pressure. A comparator receives both the fluid pressure signal and an operation signal. The pressure signal is compared to first and second pressures. When the operation signal indicates the dispenser is open, the monitor will generate a malfunction signal if the pressure signal is not on or between the first and second pressures.

In a further embodiment of the instant invention, a second comparator compares the fluid pressure signal to a preselected pressure value when the dispenser is not open. If the fluid pressure signal exceeds the preselected pressure value, a malfunction signal is generated to indicate that the system pump is malfunctioning or that the system fluid pressure is inadequate.

BRIEF DESCRIPTION OF THE DRAWINGS

In the drawings, which illustrate the best mode presently contemplated.

DESCRIPTION OF THE PREFERRED EMBODIMENT

Figure 1:
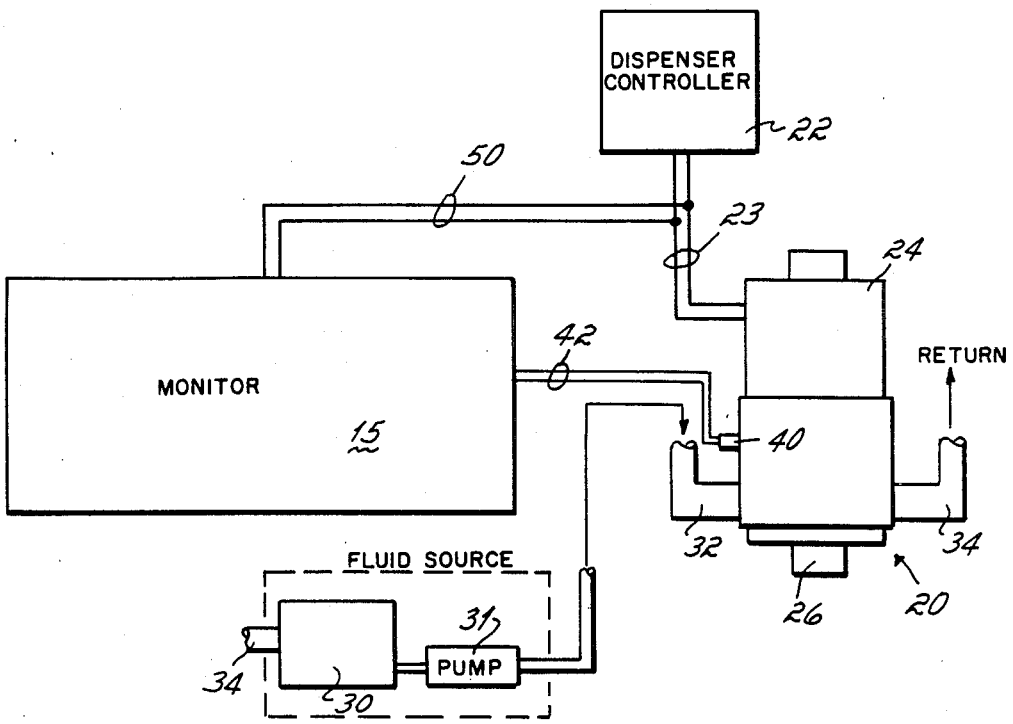
FIG. 1 is a diagram of the instant invention.

FIG. 1 shows a monitor 15 connected in a dispensing system comprised of primary dispenser 20, dispenser controller 22 and fluid source 30. The dispenser controller 22 provides an enable signal via conductors 23 to energize solenoid 24 which in turn opens a valve (not shown) in dispenser 20 to allow the fluid from the source 30 to flow through nozzle 26. The fluid to be dispensed by dispenser 20 is continuously circulated by a reciprocating pump 31 through a heated hose 32, dispenser 20, and hose 34 as shown. A sensor 40 is affixed to dispenser 20 to provide a signal reflective of the pressure of the fluid within the dispenser 20.

The dispenser 20 is preferably of the type described and illustrated in U.S. Pat. application Ser. No. 339,730, filed Jan. 15, 1982, which is assigned to the assignee of the instant invention and the disclosure of which is incorporated herein by reference.

In a preferred embodiment of the instant invention, sensor 40 is a transducer which provides an electrical signal reflective of the pressure sensed. The signal is transmitted via conductors 42 to the monitor 15. Monitor 15 also receives the enable signal provided by dispenser controller 26 via conductors 23 and 50. Monitor 15 compares the sensed pressure signal to a preselected range of pressures each time an enable signal is generated by controller 22. The magnitude or value of pressures against which the sensor signal is compared are preselected empirically to be reflective of nozzle 22 being clogged or worn.

Figure 2:
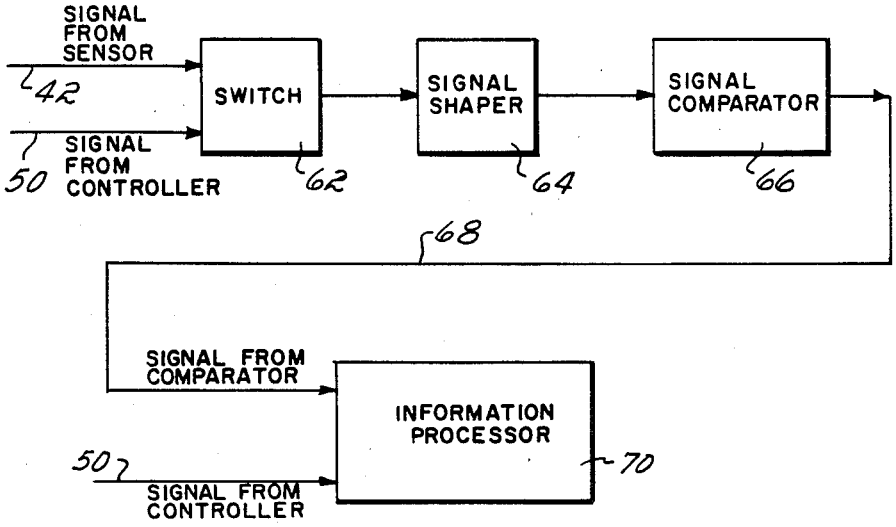
FIG. 2 is a block diagram of the monitor depicted in FIG. 1.

Switch 62, shown in FIG. 2, is a normally open switch which closes for the duration of the enable signal from controller 22. Upon closing of the switch 62, the sensor signal passes through to the signal shaper 64, which changes the pressure signal into substantially pulse form before it is transmitted to the signal comparator 66. Comparator 66 compares the magnitude of the pulse signal received from shaper 64 to preselected pressure values. If the magnitude of the shaped signal is outside the range of preselected pressure values, a malfunction signal is supplied to output 68.

In a preferred embodiment of the instant invention, monitor 15 also includes an information processor 70. Information processor 70 received the signal from the comparator output 68 and the enable signal from the controller 22 for example to increment a counter, or activate an alarm which may be audible, visual or both as selected by the user.

Figure 3:
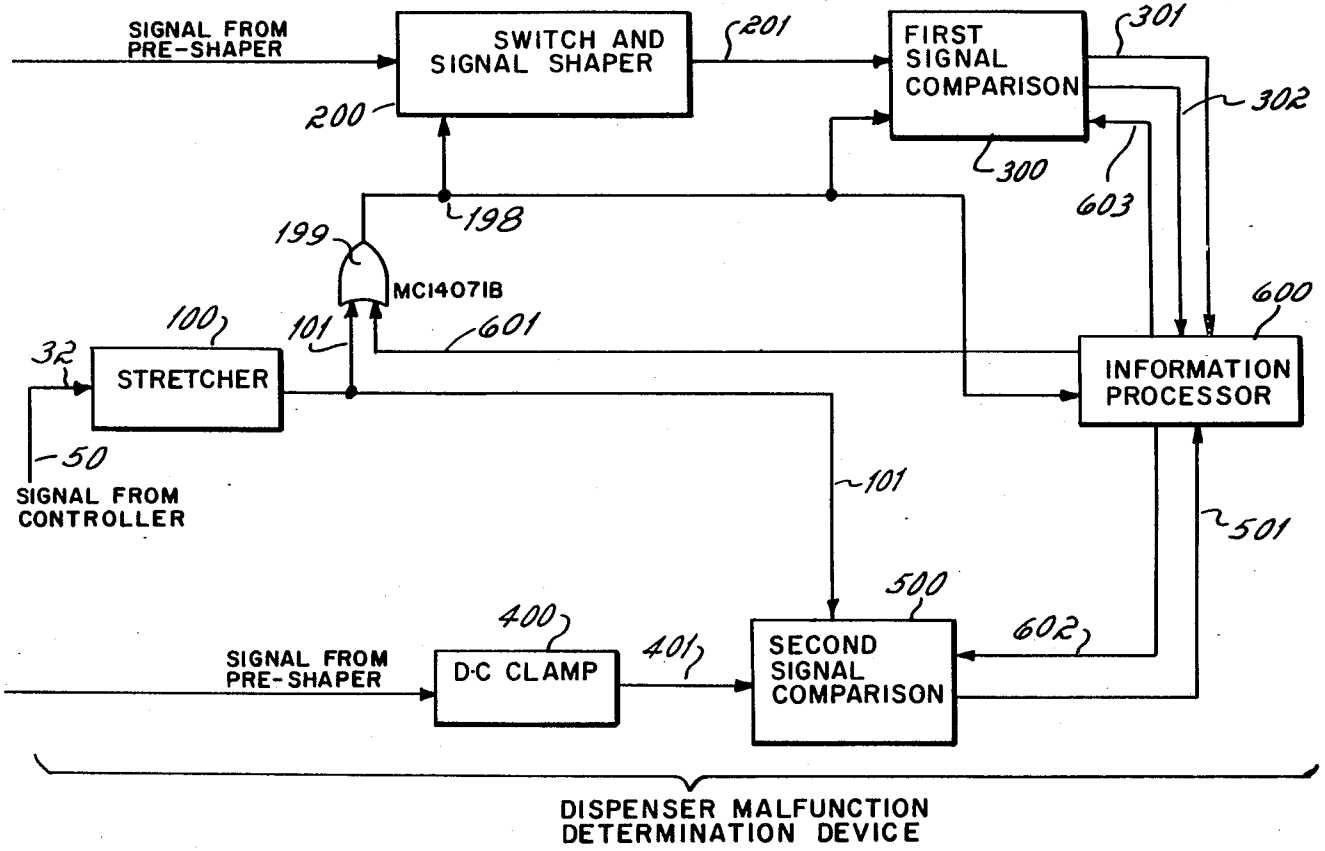
FIG. 3 is a block diagram of an alternate embodiment of the instant invention.

In the alternate embodiment shown in FIG. 3, monitor 15 receives an electrical signal from sensor 40 via conductors 42 to a pre-shaper (not shown). The pre-shaper conventionally pre-amplifies the AC and DC components of the pressure signal received from sensor 40 and inverts the pressure signal so that a drop in pressure is reflected by a positive signal amplitude.

The signal from controller 22 is transmitted through conductor 50 to a stretcher 100 which makes the enable portion of the control signal longer in time or stretched. The stretched control signal ensures that the portion of the controller signal which causes dispenser 20 to close will not be transmitted through monitor 15 until after the dispenser has actually closed. The stretched signal is thereafter transmitted to OR gate 199 and second signal comparator 500 by conductor 101. The output of OR gate 199 follows the shape of the stretched pulse signal provided by conductor 101 if the signal on conductor 601 is low. Accordingly, a signal substantially identical to that transmitted from stretcher 100 to OR gate 199 is transmitted to the switch and signal shaper 200, first signal comparator 300 and information processor 600. Switch and signal shaper 200 functions substantially the same as switch 62 and shaper 64 described hereinbefore and more fully illustrated in FIG. 5. The first signal comparator 301 compares the signal received via conductor 201 with a preselected band of pressure values which are reflective of dispenser 20 operating in a predetermined manner. A malfunction signal is generated reflective of this comparison and transmitted through comparator 301 to information processor 600. Comparator 300 will only operate on the signal from conductor 201 when the dispenser 20 is enabled by the controller 22.

It should be noted that when the dispenser has not been enabled by controller 22 the signal from sensor 40 reflects information about the third system and pump operation. The pump circulates fluid from the fluid source through dispenser 20 back to the fluid source. When a continuous action reciprocating pump is incorporated into the system, a pressure drop occurs between strokes. In a properly functioning pump, such as manufactured by Nordson Corporation, Amherst, Ohio, this pressure drop is approximately 30 to 40 psi. Should the pump performance deteriorate, for example because of worn seals, the pressure drop between strokes is approximately between 100 to 200 psi . Thus, comparing this signal to a preselected pressure value reflective of the pressure in a properly operating pump, proper performance can be monitored and mechanical defects such as a worn seal detected. This is accomplished by passing the signal from the pre-shaper through clamp 400. Clamp 400 serves to suppress any DC components of the sensor signal from the preshaper and hold that portion of the signal when the pump is stroking, i.e., when a pressure drop is not occurring, and clamps or holds that portion at a zero value. The clamped signal is transmitted to a second signal comparator 500 by conductor 401.

Second signal comparator 500 also receives the stretched pulse signal from conductor 101 so that the second signal comparator 500 will not operate when dispenser 20 has been enabled. If the clamped pressure signal from conductor 401 exceeds a preselected pressure value, comparator 500 sends a malfunction signal to information processor 600.

Figure 10:
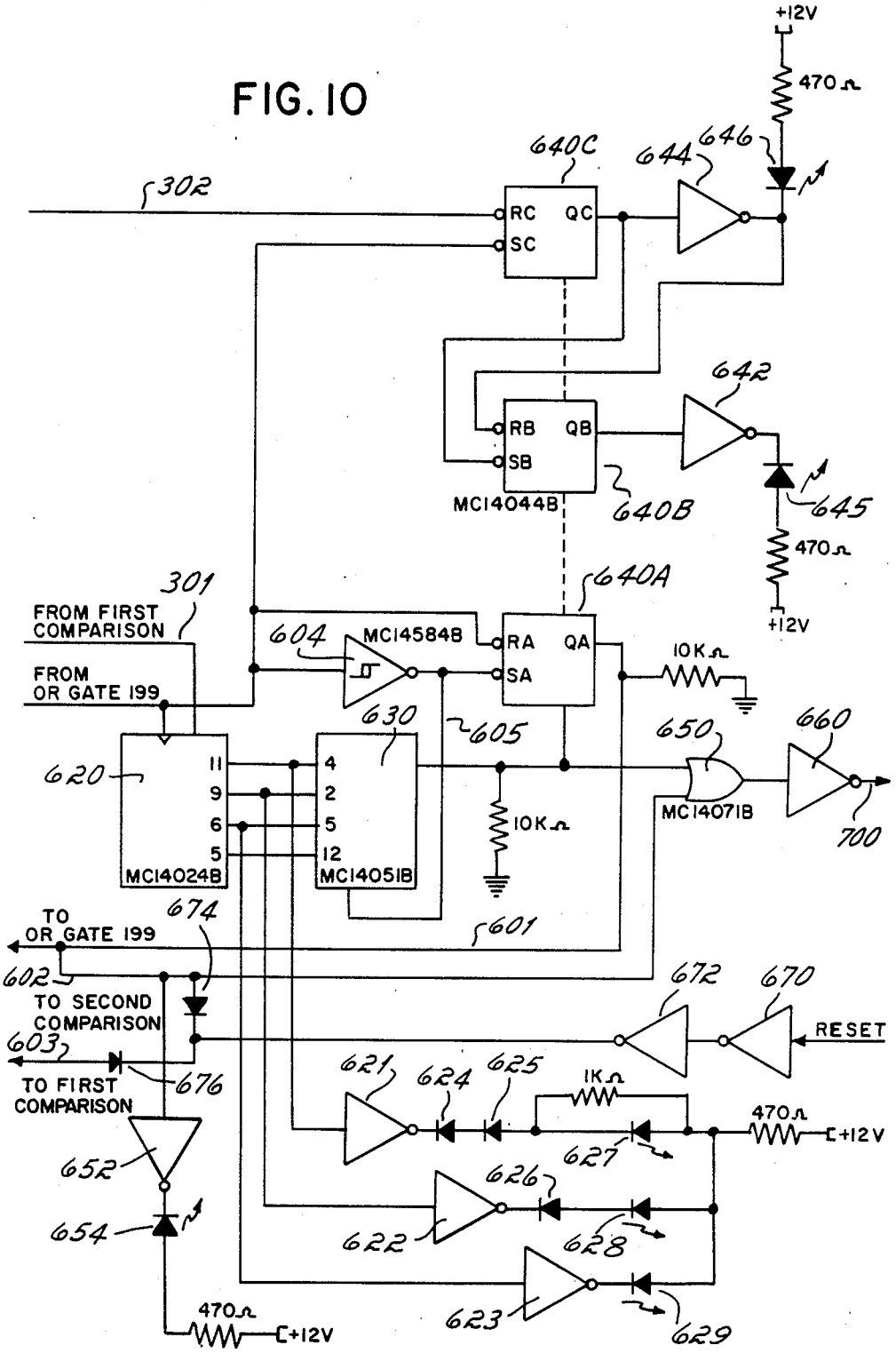
FIG. 10 is a circuit diagram of the information processor circuit of FIG. 3.

Information processor 600 receives signals from OR gate 199, comparator 300 and comparator 500. An embodiment of processor 600 will be more fully described hereinafter, to indicate the type of malfunction, significance of malfunction and/or activate an alarm or other remedial equipment. In the embodiment of FIG. 10, if a worn or clogged nozzle or worn pump seals are detected, information processor 600 transmits a signal to OR gate 199, comparator 300 and comparator 500 to prevent the monitor 15 from providing any further output. In effect monitor 15 will no longer provide malfunction signals due to conductor 601 providing a high signal to the output of OR gate 199, disabling shaper 200 and first comparison 300. As will be more fully described in connection with FIG. 10, this state continues until the monitor is reset.

Figure 4:
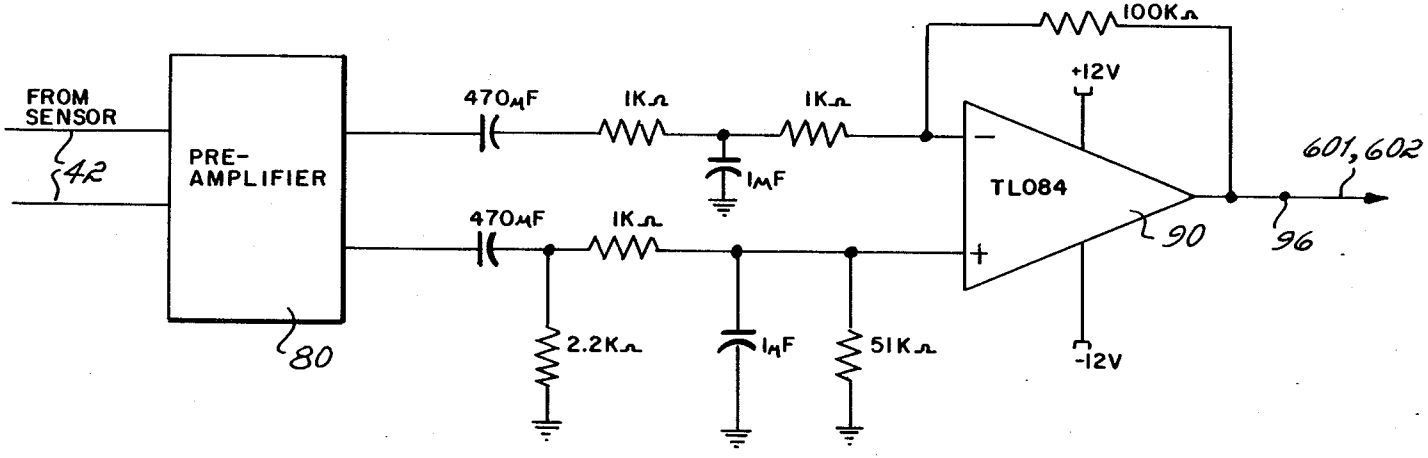
FIG. 4 is a circuit diagram of a pre-shaper circuit of FIG. 3.

FIG. 4 depicts the pre-shaper including pre-amplifier 80 previously described. The arrangement of resistors and capacitors of the values shown in FIG. 4 serves to smooth out the pressure signal removing unwanted noise. Operational amplifier 90 operates to only amplify the AC portion of the pressure signal. The signal appearing at point 96 is provided to the input of switch and signal shaper 200 and clamp 400.

Figure 5:
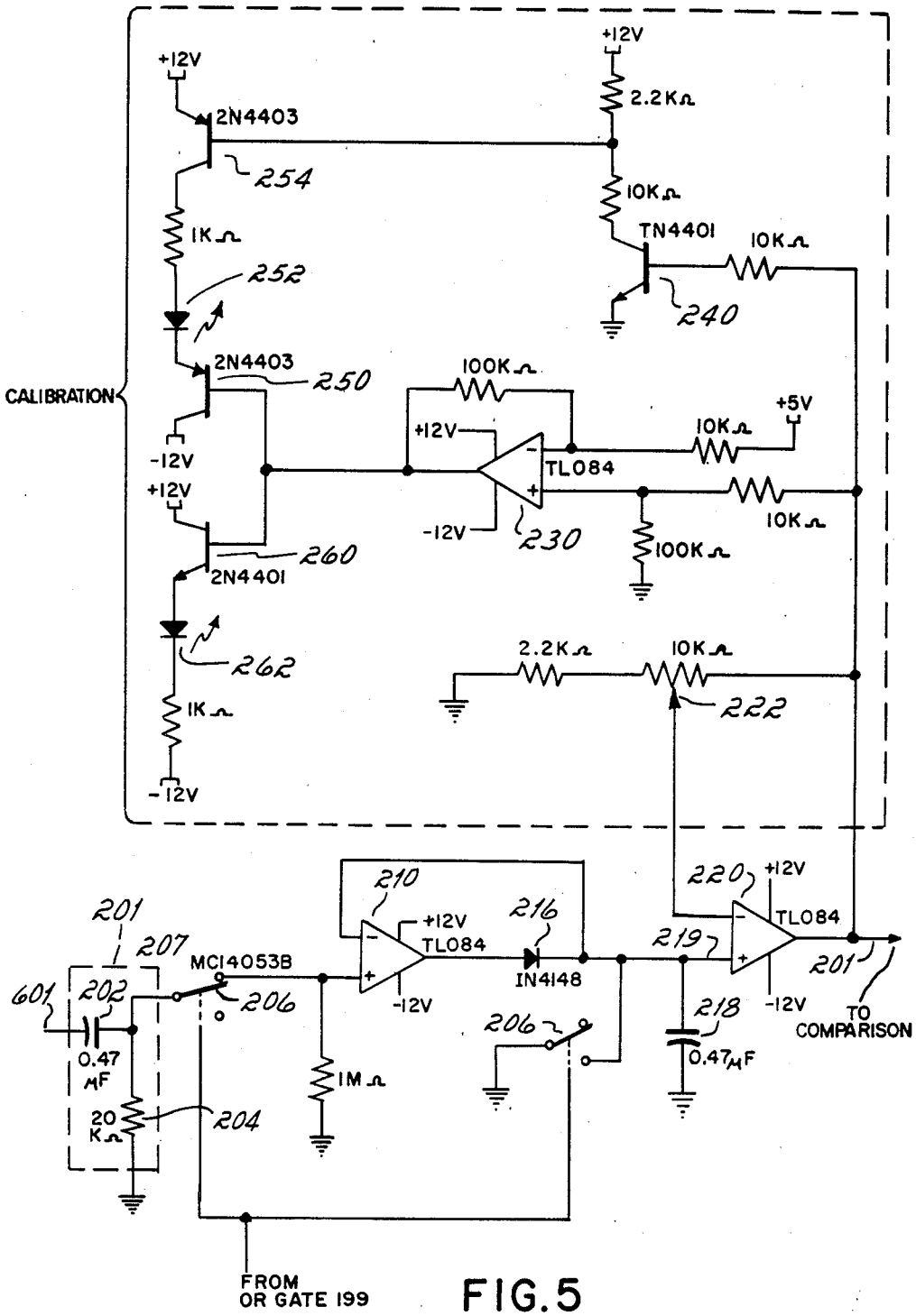
FIG. 5. is a circuit diagram of the switch and signal shaper of FIG. 3.

A circuit diagram of a preferred embodiment of switch and signal shaper 200 is shown in FIG. 5. The signal from the pre-shaper is first filtered by a high pass filter 201. The signal thereafter passes through analog switch 206. In the position shown in FIG. 5, switch 206 connects the signal from the pre-shaper to operational amplifier 210 and prevents capacitor 218 from discharging to ground at point 208 and is instead charged by amplifier 210. If the signal at point 198 forces switch 206 to move to the position opposite that shown, capacitor 218 will discharge to ground.

Calibration network 228 is used to calibrate operational amplifier 220 to have a preselected voltage output. In this embodiment, the output voltage of operational amplifier 220 is calibrated to be 5 volts when dispenser 20 is functioning properly. To calibrate, variable resistor 222 is adjusted and the brightness of light emitting diodes 252 and 262 is thereby affected. Once the diodes are of a substantially even brightness, operational amplifier 220 has been calibrated.

Figure 6:
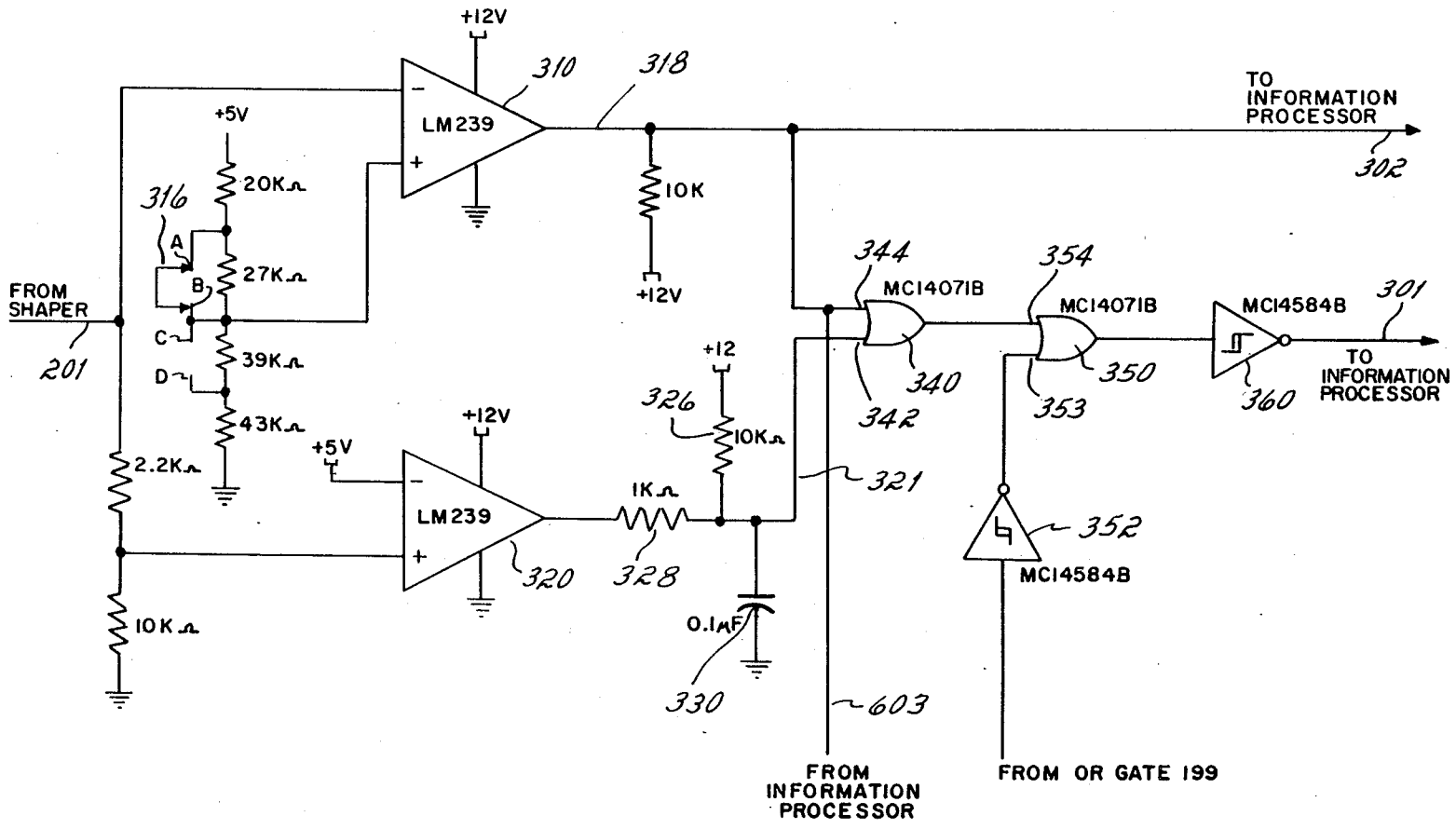
FIG. 6 is a circuit diagram of the first signal comparator circuit of FIG. 3.

The pre-shaped signal transmitted through conductor 201 is applied to the first signal comparator 300 which is shown in greater detail in FIG. 6. The signal from conductor 201 is the negative input of comparator 310 and the positive input of comparator 320. The reflective voltage as applied to comparators 310 and 320 establish the parameters of the range of preselected pressure values. comparator 310 is arranged as an inverted comparator, such that its output remains at the level of the voltage at point 318 until the input voltage from conductor 201 approaches the input voltage at point 311, at which point the comparator forces its output to ground. The reference voltage applied to input 311 is selected in the preferred embodiment by switch 316 connected to point A-B, B-C, or C-D.

Comparator 320 is arranged in FIG. 6 as a comparator, and does not have an inverted output. Operational amplifier 320 allows the voltage at point 324 to charge capacitor 330 in accordance with the time constant provided by resistor 326 and capacitor 330. Capacitor 330 will discharge through resistor 328 in accordance with the time constant associated with those two elements.

The outputs of comparators 310 and 320 is applied to the input of OR gate 340. The output of which is provided to the input 354 of OR gate 350. Schmitt trigger 360 is used to invert the output of OR gate 350 while Schmitt trigger 352 serves to invert the output from OR gate 199.

Figure 7:
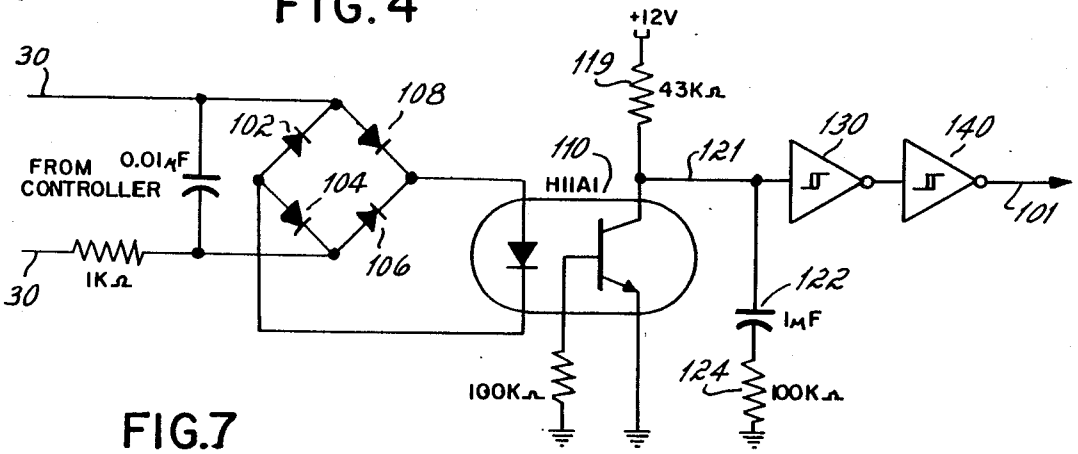
FIG. 7 is a circuit diagram of the stretcher circuit of FIG. 3.

Referring back to FIG. 1, the signal from dispenser controller 22 is transmitted via conductors 50 to the stretcher circuit shown in FIG. 7, which includes initially a diode bridge (102, 104, 106 and 108), and an optical isolator 110. Capacitor 122 is charged in accordance with the time constant associated with capacitor 122 and resistor 124, so that until the threshold level of Schmitt Trigger 130 is reached a low output is generated on conductor 101 thereby extending the signal from controller 22. Low in this embodiment is ground. The time constant is selected so that the output of trigger 140 remains high until after dispenser 20 has actually closed.

Figure 8:
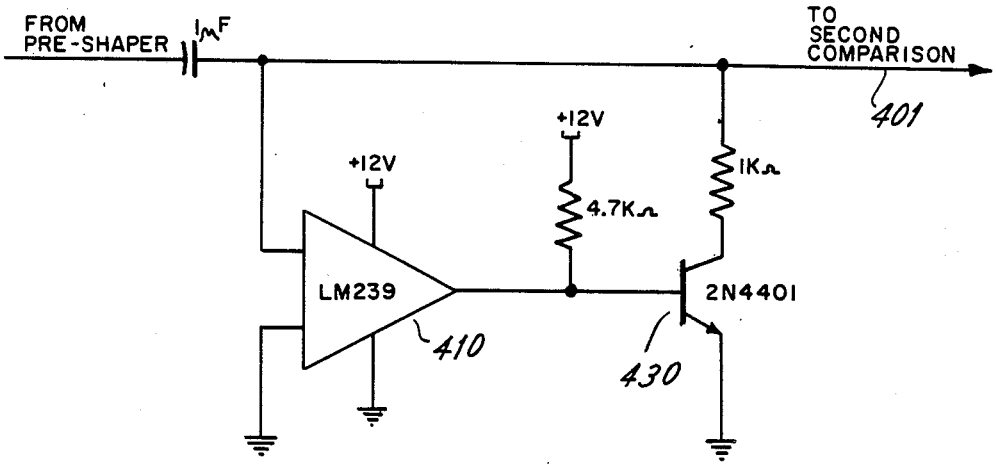
FIG. 8 is a circuit diagram of the clamp circuit of FIG. 3.
Figure 9:
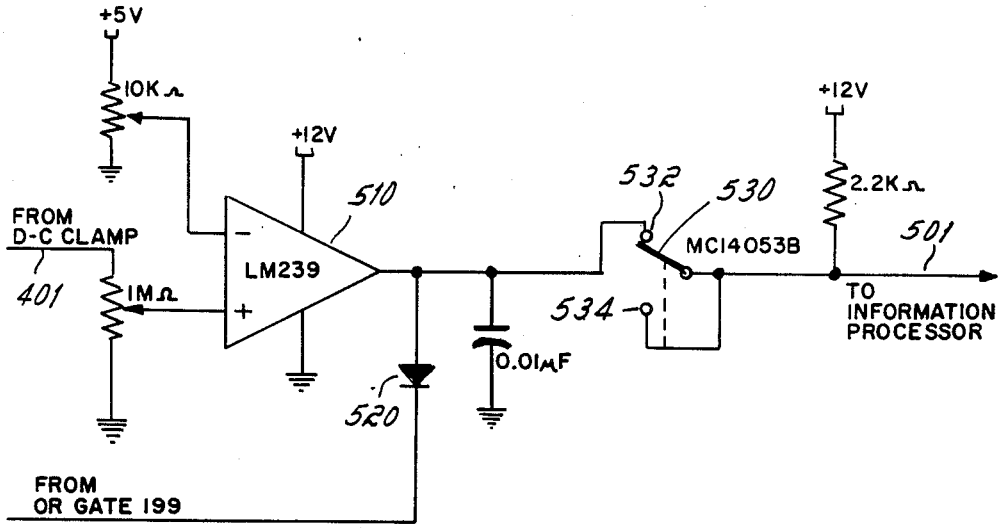
FIG. 9 is a circuit diagram of the second signal comparator circuit of FIG. 3.

The signal from the pre-shaper shown in FIG. 4 is applied to the input of clamp 400, as shown in FIG. 8, is transmitted via conductor 401 to the second signal comparator 500 shown in FIG. 9. The signal from conductor 401 passes through a variable resistor to the positive input of comparator 510 which is connected as a basic comparator. The variable resistor is adjusted so that the voltage level of the pressure signal is 2.5 volts when the dispenser is operating in an acceptable manner. Accordingly, as the signal from conductor 401 approaches the reference voltage which in this embodiment is 2.5 volts, the output of comparator 510 goes from ground to an open circuit.

While the output of comparator 510 remains grounded, the voltage at point 540 will travel to ground through the operational amplifier. When the output becomes an open circuit, the voltage at point 540 will travel through switch 530, closing the switch to point 534. Switch 530 is now latched closed and the voltage at point 540 will be transmitted via conductor 501 to information processor 600.

The output of OR gate 199, traveling through diode 520, serves to maintain switch 530 in the position shown in FIG. 9, when dispenser 20 is enabled by a signal from controller 26. A signal transmitted from stretcher 100 to the input of OR gate 199 will force the output at point 198 to go low which in turn holds the voltage at the output of comparator 510 at a level insufficient for switch 530 to change positions.

FIG. 10 is a schematic diagram of an embodiment of information processor 600. This processor counts the number of times the dispenser has dispensed material in an unacceptable fashion; it also indicates whether the sensed pressure is above or below the preselected range of pressures; and it also indicates whether the pump pressure is above the preselected value. Processor 600 also provides apparatus for resetting the system after a malfunction has been determined and monitor 15 ceases to provide any further malfunction indications. The information processor additionally provides a signal at output 700 which can be used to set off an auditory alarm, or shut down a conveyor line which may be moving substrate beneath the dispenser.

Processor 600 includes a counter 620 having its clock input as the output from OR gate 199. The reset input of the counter is connected to conductor 301. Pins 11, 9, 6 and 5 are connected to pins 4, 2, 5 and 12 of multiplexor 630. The outputs of counter 620 at pins 11, 9 and 6 are also connected to inverter drivers 621, 622 and 623 respectively. The signal from driver 621 passes through diode 624 and 625, which in this embodiment are IN4148 diodes. Thus, a high signal appearing at pin 11 of counter 620 will cause a low signal to appear at the output of driver 621, allowing the voltage to flow from point 631 through light emitting diode 627. Driver 622 and 623 operate in a similar manner. In one embodiment, light emitting diodes 627, 628 and 629 correspond to 2, 4 and 8 respective consecutive counts of dispenser malfunction.

The output of multiplexer 630 is connected to the input of OR gate 650. The output of OR gate 650 is connected to a driver inverter 660. In this embodiment all of the driver inverters depicted in FIG. 10 are Motorola MC11416B.

The output of multiplexer 630 is also provided to the enable input of OR gates 640A, 640B and 640C which in this embodiment are R-S flip-flops contained on a single electronic component such that unless the component is enabled, no output will appear at points QA, QB or QC. A Schmitt trigger inverter 604 has also been provided to this circuit.

The QA output of latch 640A is tied to ground so that a normally low signal may be applied to OR gate 199 so that the output thereof will generally follow the input provided from stretcher 100. When latch 640A is not enabled, the output at QA, QB and QC is seen as a high impedance. When the output of latch 640B becomes high, the output of driver 642 becomes low allowing the voltage applied to point 648 to flow through light emitting diode 645. Light emitting diode 646 is activated in a similar fashion.

When a high signal is provided through conductor 501 to processor 600, inverter driver 652 provides a low output, allowing the voltage at point 656 to flow through light emitting diode 654.

A reset input has also been provided, whereby inverter driver 670 and 672 provide a high signal to conductor 603 through diode 676 and to conductor 602 through diode 674.

Figure 11:
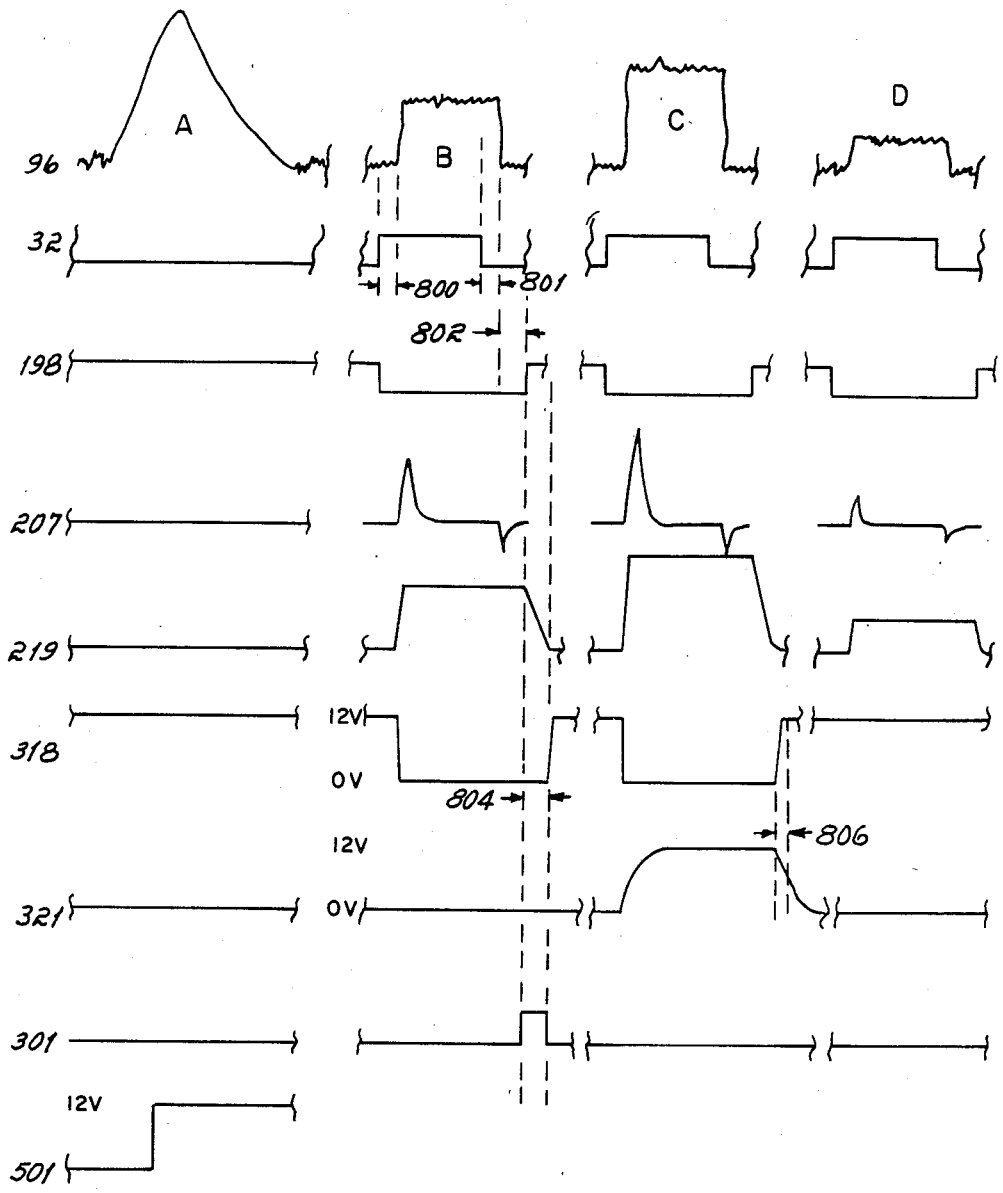
FIG. 11 is a graph of wave forms at different points in FIGS. 4 through 10, during different phases of the dispensing operation and during different dispensing conditions.

FIG. 11 depicts four pressure wave forms which appear at point 96 of the pre-shaper shown in FIG. 5. Wave form A is reflective of pump pressure. Wave form B is reflective of fluid pressure in the dispenser which is within the preselected range. Wave form C is reflective of fluid pressure in the dispenser which exceeds the preselected range, for example a pressure greater thAn 60 psi generally indicates a worn nozzle. Wave form D is reflective of fluid pressure in the dispenser 20 which is below the preselected range, for example a pressure less than 40 psi generally indicates a clogged nozzle. The height of the wave form is in terms of voltage and the length of the wave form is in relation to time.

Wave form A signifies a pressure drop sensed between strokes of the reciprocating piston pump referred to hereinabove. This signal is acted on when dispenser 20 is not enabled as shown by the wave form appearing at point 32. "Low" in the preferred embodiment refers to the signal being zero volts or grounded. When the signal at point 32 is continuously low, the signal at Point 198 is continuously high. Accordingly, latch 206 will be in the position opposite that which is shown in FIG. 5. Consequently, the wave form appearing at points 207 and 219 is a low signal. Since the signal at point 219 is continuously low, the output of comparators 310 and 320 at points 318 and 321 will be continuously high and continuously low respectively. This in turn provides a continuously high output from OR gate 340 to the input of OR gate 350 at point 354. With the wave form at point 198 continuously high, inverter 352 provides a continuously low input to OR gate 350 at point 353. Accordingly, the output of OR gate 350 will be continuously high and the wave form appearing on conductor 301 is continuously low.

When the wave form at point 198 is high, switch 530 in FIG. 9 is vulnerable to change from the position shown to point 534 if the pump pressure exceeds the reference established in comparator 510. For the purposes of illustration, it is assumed that wave form A has exceeded the preselected pressure value. Consequently, point 198 is grounded and the voltage at point 540 flows through switch 530 latching it to point 534.

Wave form B of FIG. 11 represents an acceptable pressure condition in dispenser 20. Since the dispenser has been enabled, a signal of the type shown appears at point 32. As previously described, dispenser 20 has an inherent mechanical delay between the time when the enabling signal is received and the time when the dispenser actually opens. This same condition occurs at the time of closing. These two conditions are depicted in FIG. 11 by the time periods designated 800 and 801 respectively.

Since dispenser 20 has been enabled, a signal will now appear at point 198. The stretched output at point 198 is designated 802. Since the wave form at point 198 becomes low, switch 206 will be in the position shown in FIG. 5. The wave form at point 207 will appear as shown in FIG. 11 and will be detected by operational amplifier 210 which serves to charge capacitor 218. Consequently, the signal appearing at point 219 is reflective of capacitor 218 charging and discharging. The time of discharge causes the output of comparator 310 to remain low at point 318 until the capacitor has discharged to a point where its voltage is below the reference voltage applied at point 311. This period of time is designated 804 in FIG. 11. Since the voltage of the wave form at point 219 does not exceed the reference voltage at point 324 applied to comparator 320, the output at point 321 will remain continuously low. It becomes apparent that during the time period 804, OR gate 340 will have a low signal applied to inputs 342 and 344. Consequently, a pulse will appear in the wave form being transmitted by conductor 301. This pulse serves to reset counter 620, shown in FIG. 10 from having counted the rising edge of the wave form at point 198. This count has now been erased and no enabling signal is applied to the latches 640 A, B or C.

Wave form C is reflective of a high pressure drop in dispenser 20, which for example may be generally indicative of a worn dispenser nozzle in the can coating process described herein. Since the dispenser 20 has been enabled, a signal identical to that described in connection with wave form B is present at points 32 and 198. The wave form appearing at point 207 is similar to that appearing for wave form B except for magnitude. Consequently, the wave form appearing at point 219 is very similar to that discussed in connection with wave form B, except that its amplitude is higher. With this high signal at point 219, the output of comparator 310 at point 318 is generally identical to the wave form discussed in connection with wave form B, except that the time 804 may be slightly longer since capacitor 218 has been charged to a higher voltage. With the pressure drop of wave form C being so high, the reference voltage at point 324 for comparator 320 has been exceeded, consequently, the voltage at point 324 will be allowed to charge capacitor 330 in accordance with the time constant of resistor 326 and capacitor 330. This signal appears at point 321. When capacitor 218 has discharged sufficiently such that the input to comparator 320 is less than the reference voltage at point 324, capacitor 330 will discharge through resistor 328 to ground according to the time constant for those components. The discharge of the capacitor delays the voltage at point 321 from becoming zero because if a low signal is provided to inputs 344 and 342 of OR gate 340, a low signal will be provided to input 354 of OR gate 350 which will force OR gate 350 to go temporarily low providing a false pulse to conductor 301. Accordingly, the time constant established by resistor 328 and capacitor 330 allows sufficient time, designated as 806 on Fig. 11, for the signal at point 318 to return to high. The resultant signal on conductor 301 is a continuous low. Since no pulse appears on conductor 301, counter 620 of information processor 600 is not reset and the rising edge at point 198 clocks the counter.

If counter 620 were to have counted a preselected number of consecutive pulses from OR gate 199, a signal is transmitted through multiplexor 630 to OR gate 650 and enables latches 640A, B and C. The point RA of latch 640A will receive a high signal while the point SA receives a low signal, providing a high output at point QA. Schmitt trigger inverter 604 also provides a high signal to the inhibit input of multiplexor 630 through conductor 605. Since the output at QA is high, the output of OR gate 199 will remain high, effectively "freezing" the system.

When the enable signal is provided by multiplexor 630, the latch 640C, for wave form C, has a high input at RC and a high input at SC providing a low output at QC. The low output at QC in turn provides a high input at SB and after being inverted by inverter driver 644, provides a low input at RB providing a high output at QB. The subsequent activation of light emitting diode 645 indicates that a high pressure drop condition has occurred.

Wave form D of FIG. 11 is reflective of a pressure drop in dispenser 20 which is too low indicating a clog. Since dispenser 20 has been enabled, a signal occurs at points 32 and 198 which has been discussed in greater detail in connection with wave form B. Switch 206 will thus be in the position shown in the drawings and the wave form at point 207 will be present. The charging of capacitor 218 again yields the wave form shown at point 219. The signal at point 219 is relatively smaller in amplitude such that neither of the reference voltages for comparators 310 or 320 is approached, consequently, the output at point 318 remains high and the wave form at point 321 remains low for the entire enabling time. Since a high-low signal is presented to the inputs of OR gate 340, a high output will be presented to input 354 of OR gate 350. Accordingly, OR gate 350 will have a high output which will provide a low output signal by Schmitt trigger inverter 360 on conductor 301. As previously discussed, a low signal on conductor 301 permits counter 620 to count the pulse output of OR gate 199. If wave form D represents the appropriate number of consecutive counts by counter 620, multiplexer 630 will provide a high signal to OR gate 650 and also enable latches 640A, B and C. Since the output of comparator 310 remains continuously high, a low signal will be applied to the RC input of latch 640C. As previously discussed, a high signal is received at input SC. In the preferred embodiment, inverters have been placed before each of the inputs of latches 640A, B and C and the inputs of the fourth unused latch (not shown in the drawings) contained in the set have been each tied to ground. Once enabled, the latch 640C will have a high output at QC. The activation of light emitting diode 646, indicates that the pressure drop in dispenser 20 is too small.

Changes and modifications in the specifically described embodiments can be carried out without departure from the scope of the invention which is intended to be limited only by the scope of the appended claims.

I claim:

1. A liquid dispensing and malfunction indicating system comprising:

a dispenser having a nozzle through which pressurized liquid is dispensed, said nozzle being capable of becoming (a) clogged in which event said pressurized liquid is dispensed at a below-normal rate and (b) worn in which event said pressurized liquid is dispensed at an above-normal rate, said liquid being dispensed at a normal rate when said nozzle is neither clogged or worn;

a source of pressurized liquid;

liquid conduit means interconnecting said pressurized liquid source and said dispenser;

a control signal-operated valve connected between said dispenser nozzle and said source of pressurized liquid for controlling the flow of pressurized liquid to said nozzle, said valve being opened in response to a first control signal and closed in response to a second control signal;

a pressure transducer for sensing the pressure of said liquid upstream of said nozzle and providing a pressure signal correlated thereto;

a first reference signal source for providing a maximum pressure reference signal correlated to the maximum liquid pressure upstream of said valve when said valve is open and said nozzle unclogged;

a second reference signal source for providing a minimum pressure reference signal correlated to the liquid pressure upstream of said valve when said valve is open and said nozzle worn;

a source of control signals for repetitively selectively providing said first and second control signals to repetitively open and close said valve, respectively, to repetitively dispense controlled amounts of fluid from said nozzle;

comparison means responsive to said control signals and said pressure signals for comparing said pressure signal to said maximum and minimum pressure reference signals when said first control signal is output from said control signal source to open said valve; and nozzle malfunction means responsive to said comparator output only when said first control signal is present to open said valve for providing a nozzle malfunction output when said valve nozzle is clogged or worn in response to said pressure signal from said pressure transducer exceeding said maximum pressure reference signal or falling below said minimum pressure reference signal, respectively.

2. The system of claim 1 wherein said pressurized liquid source includes a continuously operated reciprocating pump having an input and an output which causes the pressure of said liquid between the pump output and said valve to cyclically change between upper and lower pressure valves each pump stroke when said valve is closed and liquid is not being dispensed via said nozzle;

said system further including liquid bypass means interconnecting said source of pressurized liquid and conduit means upstream of said valve for recirculating said liquid from said pump output to said pump input when said valve is closed and liquid is not being dispensed via said nozzle; and means responsive to said second control signal and said pressure signal output from said pressure transducer for providing a pump malfunction indication if when the valve is closed the cyclical pressure change each pump stroke exceeds a specified differential pressure value correlated to proper pump operation.

3. A liquid dispensing and malfunction indicating system comprising:

a dispenser having a nozzle through which pressurized liquid is dispensed, said nozzle being capable of becoming clogged in which event said pressurized liquid is dispensed at a below-normal rate, said liquid being dispensed at a normal rate when said nozzle is not clogged;

a source of pressurized liquid;

liquid conduit means interconnecting said pressurized liquid source and said dispenser;

a control signal-operated valve connected between said dispenser nozzle and said source of pressurized liquid for controlling the flow of pressurized liquid to said nozzle, said valve being opened in response to a first control signal and closed in response to a second control signal;

a pressure transducer for sensing the pressure of said liquid upstream of said nozzle and providing a pressure signal correlated thereto;

a reference signal source for providing a maximum pressure reference signal correlated to the maximum liquid pressure upstream of said valve when said valve is open and said nozzle unclogged;

a source of control signals for repetitively providing said first and second control signals to repetitively open and close said valve, respectively, to repetitively dispense controlled amounts of fluid from said nozzle;

comparison means responsive to said control signals for comparing said pressure signal to said maximum pressure reference signal when said first control signal is output from said control signal source to open said valve; and nozzle malfunction means responsive to said comparator output only when said first control signal is present to open said valve for providing a nozzle malfunction output when said valve nozzle is clogged in response to said pressure signal from said pressure transducer exceeding said maximum pressure reference signal.

4. A liquid dispensing and malfunction indicating system comprising:

a dispenser having a nozzle through which pressurized liquid is dispensed, said nozzle being capable of becoming worn in which event said pressurized liquid is dispensed at an above-normal rate, said liquid being dispensed at a normal rate when said nozzle is not worn;

a source of pressurized liquid;

liquid conduit means interconnecting said pressurized liquid source and said dispenser;

a control signal-operated valve connected between said dispenser nozzle and said source of pressurized liquid for controlling the flow of pressurized liquid to said nozzle, said valve being opened in response to a first control signal and closed in response to a second control signal;

a pressure transducer for sensing the pressure of said liquid upstream of said nozzle and providing a pressure signal correlated thereto;

a reference signal source for providing a minimum pressure reference signal correlated to the liquid pressure upstream of said valve when said valve is open and said nozzle worn;

a source of control signals for repetitively selectively providing said first and second control signals to repetitively open and close said valve, respectively, to repetitively dispense controlled amounts of fluid from said nozzle;

comparison means responsive to said control signals for comparing said pressure signal to said minimum pressure reference signal when said first control signal is output from said control signal source to open said valve; and nozzle malfunction means responsive to said comparator output only when said first control signal is present to open said valve for providing a nozzle malfunction output when said valve nozzle is worn in response to said pressure signal from said pressure transducer falling below said minimum pressure reference signal.

5. A liquid dispensing and malfunction indicating system comprising:

a dispenser having a nozzle through which pressurized liquid is dispensed;

a source of pressurized liquid;

liquid conduit means interconnecting said pressurized liquid source and said dispenser;

a control signal-operated valve connected between said dispenser nozzle and said source of pressurized liquid for controlling the flow of pressurized liquid to said nozzle, said valve being opened in response to a first control signal and closed in response to a second control signal;

a pressure transducer for sensing the pressure of said liquid upstream of said nozzle and providing a pressure signal correlated thereto;

said pressurized liquid source including a continuously operated reciprocating pump having an input and an output which causes the pressure of said liquid between the pump output and said valve to cyclically change between upper and lower pressure valves each pump stroke when said valve is closed and liquid is not being dispensed via said nozzle;

liquid bypass means interconnecting said source of pressurized liquid and conduit means upstream of said valve for recirculating said liquid from said pump output to said pump input when said valve is closed and liquid is not being dispensed via said nozzle; and means responsive to said second control signal and said pressure signal output from said pressure transducer only when said valve is closed for providing a pump malfunction indication if when the valve is closed the cyclical pressure change each pump stroke exceeds a specified differential pressure value correlated to proper pump operation.

* * * * *